US011761317B2

(12) United States Patent
Stephenson et al.

(10) Patent No.: US 11,761,317 B2
(45) Date of Patent: Sep. 19, 2023

(54) DECOUPLED LONG STROKE PUMP

(71) Applicant: Halliburton Energy Services, Inc., Houston, TX (US)

(72) Inventors: Stanley V. Stephenson, Duncan, OK (US); Timothy Holiman Hunter, Duncan, OK (US); Jim Basuki Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 235 days.

(21) Appl. No.: 17/283,134

(22) PCT Filed: Nov. 7, 2018

(86) PCT No.: PCT/US2018/059674

§ 371 (c)(1),
(2) Date: Apr. 6, 2021

(87) PCT Pub. No.: WO2020/096593

PCT Pub. Date: May 14, 2020

(65) Prior Publication Data

US 2021/0388705 A1 Dec. 16, 2021

(51) Int. Cl.
*E21B 43/26* (2006.01)
*F04B 15/02* (2006.01)
(Continued)

(52) U.S. Cl.
CPC ..... *E21B 43/2607* (2020.05); *F04B 15/02* (2013.01); *F04B 47/145* (2013.01); *F04B 49/12* (2013.01)

(58) Field of Classification Search
CPC ..... E21B 43/26; E21B 43/2607; F04B 49/12
See application file for complete search history.

(56) References Cited

U.S. PATENT DOCUMENTS 3,048,226 A 8/1962 Smith
3,602,311 A 8/1971 Whitsitt
(Continued)

FOREIGN PATENT DOCUMENTS

WO 2016/141205 A2 9/2016
WO 2016/207631 A1 12/2016

OTHER PUBLICATIONS

International Search Report and Written Opinion issued in related PCT Application No. PCT/US2018/059674 dated Aug. 2, 2019, 15 pages.

(Continued)

*Primary Examiner* — Matthew R Buck
(74) *Attorney, Agent, or Firm* — Conley Rose, P.C.; Rodney B. Carroll

(57) ABSTRACT

Methods for operating a decoupled long stroke pump to pump treatment fluid to a wellbore are provided. The decoupled long stroke pump has relatively long stroke plungers that can be powered by hydraulics, linear electric motors, mechanical long stroke mechanisms, linear actuators, or any other device that can provide a linear force to the plungers. Such long stroke pumps have the suction and discharge strokes decoupled such that an absolute linear flow rate without pressure pulses on the suction or discharge can be produced. Any desired flow profile of the treatment fluid can be produced via the decoupled long stroke pump.

20 Claims, 6 Drawing Sheets

(51) Int. Cl.
*F04B 47/14* (2006.01)
*F04B 49/12* (2006.01)

(56) References Cited

U.S. PATENT DOCUMENTS

| | | | | |
|---|---|---|---|---|
| 3,847,511 | A * | 11/1974 | Cole | F04B 1/02 417/342 |
| 3,967,542 | A | 7/1976 | Hall et al. | |
| 4,527,954 | A | 7/1985 | Murali et al. | |
| 4,555,220 | A | 11/1985 | Hall et al. | |
| 5,616,009 | A | 4/1997 | Birdwell | |
| 5,634,779 | A * | 6/1997 | Eysymontt | F04B 9/1178 417/342 |
| 8,412,472 | B2 | 4/2013 | Kyllingstad | |
| 8,807,960 | B2 | 8/2014 | Stephenson et al. | |
| 9,322,397 | B2 | 4/2016 | Burnette | |
| 11,035,223 | B2 * | 6/2021 | Kabannik | G01V 1/44 |
| 2014/0174717 | A1 | 6/2014 | Broussard et al. | |
| 2015/0192117 | A1 * | 7/2015 | Bridges | F04B 23/06 417/364 |
| 2019/0331100 | A1 * | 10/2019 | Gable | F04B 11/005 |
| 2020/0109610 | A1 * | 4/2020 | Husøy | F04B 9/1172 |

OTHER PUBLICATIONS

International Preliminary Report on Patentability issued in related PCT Application No. PCT/US2018/059674 dated May 20, 2021, 10 pages.

* cited by examiner

DECOUPLED LONG STROKE PUMP

CROSS-REFERENCE TO RELATED APPLICATION

The present application is a U.S. National Stage Application of International Application No. PCT/US2018/059674 filed Nov. 7, 2018, which is incorporated herein by reference in its entirety for all purposes.

TECHNICAL FIELD

The present disclosure relates generally to treatment operations for hydrocarbon wells, and more particularly, to method of using decoupled long stroke pumps for well stimulation operations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Subterranean operations involve a number of different steps such as, for example, drilling a wellbore at a desired well site, treating and stimulating the wellbore to optimize production of hydrocarbons, and performing the necessary steps to produce and process the hydrocarbons from the subterranean formation.

Treating and stimulating a wellbore can include, among other things, delivering various fluids (along with additives, proppants, gels, cement, etc.) to the wellbore under pressure and injecting those fluids into the wellbore. One example treatment and stimulation operation is a hydraulic fracturing operation in which the fluids are highly pressurized via pumping systems to create fractures in the subterranean formation. The pumping systems typically include crankshaft pumps, which are high-pressure, reciprocating pumps driven through conventional transmissions by diesel engines. These are used due to their ability to provide high torque to the pumps. Unfortunately, large maintenance costs are associated with the fluid ends and transmissions of such pumps used in stimulation operations.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
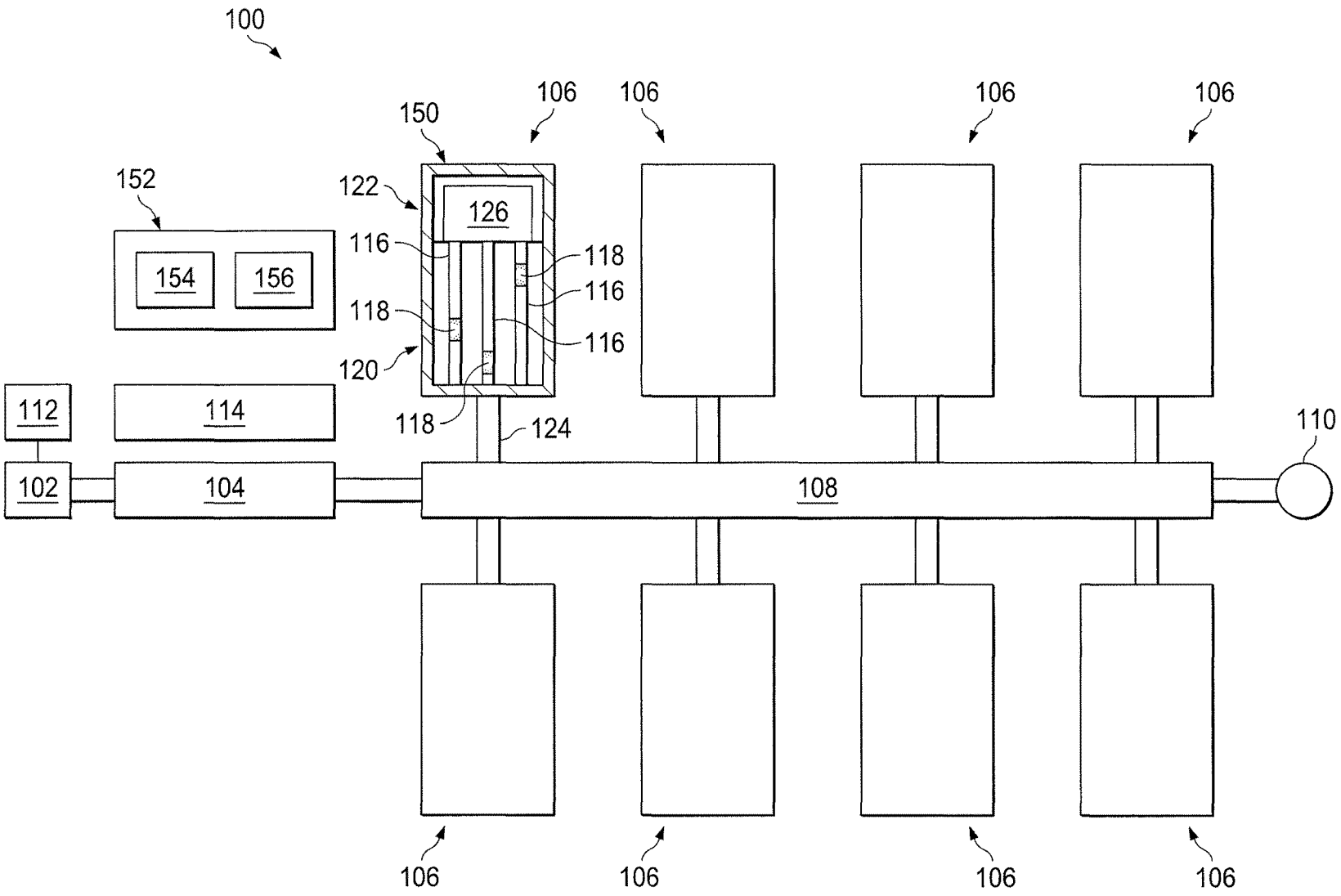
FIG. 1 is a diagram illustrating a system for wellbore treatment and stimulation operations, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The terms "couple" or "couples" as used herein are intended to mean either an indirect or a direct connection. Thus, if a first device couples to a second device, that connection may be through a direct connection, or through an indirect mechanical or electrical connection via other devices and connections. The term "fluidically coupled" or "in fluid communication" as used herein is intended to mean that there is either a direct or an indirect fluid flow path between two components.

The present disclosure is directed to a decoupled long stroke pump used to pump a treatment fluid during a well stimulation operation. The decoupled long stroke pump provides a reduction in pressure cycles and does not require a multi-gear ratio transmission, as opposed to existing crankshaft pumps.

Crankshaft pumps used for well stimulation operations have high maintenance costs associated therewith due to failures at the fluid ends and transmissions. The primary failure mode for fluid ends is fatigue. There are three ways to reduce fatigue in the fluid ends: 1) reduce stress; 2) reduce the number of pressure cycles; and 3) improve the metallurgy of the fluid ends. Smaller plungers will reduce stress, but this results in needing a larger number of pumps to do the same work. Metallurgical improvements will provide some improvement of the fatigue life at a given stress level. Pressure cycles can be reduced in two ways: 1) increasing plunger size to deliver more fluid per stroke; or 2) increasing stroke length of the plunger. Increasing the plunger size, however, increases the stress on the fluid ends, resulting in lower fatigue life since stress increases exponentially with respect to increases in pressure. This leaves reduction of pressure cycles by increasing the stroke length of the plunger. Crankshaft pumps are limited in stroke length due to size and weight restrictions.

The disclosed methods address these shortcomings and others associated with using crankshaft pump systems for well stimulation operations. The disclosed methods are directed to using a decoupled long stoke pump, instead of a traditional crankshaft pump, to pump treatment fluid downhole in a stimulation operation. A decoupled long stroke pump can have relatively long stroke (5 to 6 feet long) plungers that can be powered by hydraulics, linear electric motors, mechanical long stroke mechanisms, linear actuators, or any other device that can provide a linear force to the plungers. Such long stroke pumps have the suction and discharge strokes decoupled such that an absolute linear flow rate without pressure pulses on the suction or discharge can be produced. Any desired flow profile of the treatment fluid can be produced via the decoupled long stroke pump as well.

The decoupled long stroke pump provides a reduced number of pressure cycles on the fluid end due to the longer stroke length. As compared to existing crankshaft pumps with a typical stroke length of 10 inches, the long stroke pumps with stroke length of from 20 inches to up to 60 inches or more provide the required pumping with a fraction of the number of pressure cycles on the fluid end. This reduces the failure rate of the pump fluid ends compared to crankshaft pump systems.

Other improvements provided by the decoupled long stroke pumping method are provided as well. The decoupled long stroke pump provides a flat constant fluid rate, on the suction and discharge line. The decoupled long stroke pump allows for phasing of the plungers of the pump. Whereas in crankshaft pumps, all the plungers are directed by a single crankshaft motor at the power end, the presently disclosed long stroke pumps have the plungers de-coupled, meaning that each plunger can be individually controlled. With three or more plungers in a decoupled long stroke pump, it is possible to independently control the suction and discharge rates.

FIG. 1 is a diagram illustrating an example system 100 for well treatment operations, according to aspects of the present disclosure. The system 100 includes a fluid management system 102 in fluid communication with a blender system 104. The blender system 104 may in turn be in fluid communication with one or more pump systems 106 through a fluid manifold system 108. The fluid manifold system 108 may provide fluid communication between the pump systems 106 and a wellbore 110. In use, the fluid management system 102 may receive water or another fluid from a fluid source 112 (e.g., a ground water source, a pond, one or more frac tanks), mix one or more fluid additives into the received water or fluid to produce a treatment fluid with a desired fluid characteristic, and provide the produced treatment fluid to the blender system 104. The blender system 104 may receive the produced treatment fluid from the fluid management system 102 and mix the produced treatment fluid with a proppant, such as sand, or another granular material 114 to produce a final treatment fluid that is directed to the fluid manifold 108. The pump systems 106 may then pressurize the final treatment fluid to generate pressurized final treatment fluid that is directed into the wellbore 110, where the pressurized final treatment fluid generates fractures within a formation in fluid communication with the wellbore 110.

In accordance with presently disclosed embodiments, the pump systems 106 may be decoupled long stroke pump systems. The disclosed pump systems 106 may each include at least two elongated cylinders 116 through which treatment fluid is pressurized via corresponding rods/plungers 118. The cylinders are part of a fluid end 120 of the pump system 106, and the pump system 106 also includes a power end 122 for supplying motive force for the rods/plungers 118 moving through the cylinders 116 of the fluid end 120. As shown, the pump system 106 may be a triplex pump having three cylinders 116. In other embodiments, the pump system 106 may include a double acting duplex pump having two cylinders. The power end 122 provides control of the position of the rods/plungers for suction, discharge, and pre-compression modes of operation. That is, the power end 122 is controllable to provide independent movement of the rod/plunger 118 in the forward and backward directions within the cylinder 116. The cylinders 116 are all fluidly connected to the same suction line 124 of the fluid manifold system 108. Although only one of the pump systems 106 of FIG. 1 is illustrated in detail to show these different parts of the decoupled long stroke pump system, it should be understood that the other pumps 106 of FIG. 1 may feature a similar structure.

The term "decoupled" refers to the elongated cylinders 116 of the pump system 106 being operated such that the position of a plunger 118 in any one of the three cylinders 116 is not tied to the position of a plunger 118 in any other one of the three cylinders 116. Unlike in crankshaft driven pumps, where the position of the crankshaft controls the position of each one of the connected plungers/rods of the pump, the decoupled long stroke pump 106 enables independent control of the positions of each of the associated plungers/rods 118 within their respective cylinders 116.

The power end 122 of the pump systems 106 may include or be coupled to any desired type of drive system 126. In some embodiments, the drive system 126 may include one or more engines. Since the engines would be run at full speed and would be high on their torque curve, there will be no issues with having enough torque to come online under pressure. This allows the use of diesel engines, spark ignited engines, or turbine engines. The engines may receive energy or fuel in one or more forms from sources at the well site. The energy or fuel may include, for instance, hydrocarbon-based fuel, hydraulic energy, thermal energy, etc. The sources of energy or fuel may include, for instance, on-site fuel tanks, mobile fuel tanks delivered to the site, hydraulic pumping systems, etc. The engines may then convert the fuel or energy into mechanical energy that can be used to drive the associated pump 106. For example, the engines may power pumps that provide hydraulic fluid to the power end 122 for actuating the cylinders 116 of the long stroke pump 106. In other embodiments, the drive system 126 may include an electric motor or an electric driven linear force actuator. The power end 122 of the decoupled long stroke pump 106 may utilize any of the following for stroking the cylinders 116: hydraulics, electric linear motors, roller screws, long stroke linear mechanisms, or any other device providing linear power.

As illustrated, the pump system 106 may include a skid or trailer 150 onto which all components of the pump system 106 are mounted. For example, the fluid end 120 and power end 122 are mounted on the skid or trailer 150. This arrangement may enable the pump system 106 to be assembled at a different location and transported to the well site in one piece. Due to the stroke length of the decoupled long stroke pump, the skid or trailer 150 may include multiple separate skids/trailers that are transported individually to the well site and easily assembled together there.

In certain embodiments, the pump systems 106 may be communicatively coupled to a controller 152 that directs the operation of the power end 122 of the pump systems 106. The controller 152 may include, for instance, an information handling system that sends one or more control signals to the pump systems 106 to control the components of the drive system 126 and/or the power end 122. For example, in embodiments where the drive system 126 provides hydraulic force to the power end 122, the controller 152 may output control signals to the drive system 126 for controlling the amount of hydraulic force communicated. Additionally, or alternatively, the controller 152 may output control signals to various valves (not shown) within the power end 122 to control the mode of operation of the cylinders 116.

As used herein, an information handling system may include any system containing a processor 154 and a memory device 156 coupled to the processor 154. The memory device 156 contains a set of instructions that, when executed by the processor 154, cause the processor 154 to perform certain functions. The control signals may take whatever form (e.g., electrical, hydraulic, pneumatic) is necessary to communicate with the associated drive system 126 and/or power end 122. For instance, a control signal to the drive system 126 may include a hydraulic or pneumatic control signal to one or more variable control valves, which may receive the control signal and alter the operation of the drive system 126 based on the control signal. In other embodiments, a control signal to the drive system 126 may include an electrical control signal to one or more electric linear motors, roller screws, or long stroke linear mechanisms, which may receive the control signal and alter the operation of the drive system 126 based on the control signal. Similarly, control signals in the form of hydraulic, pneumatic, or electrical control signals may be communicated to valves, linear actuators, or other components of the power end 122.

In certain embodiments, the controller 152 may also be communicatively coupled to other elements of the system, including the fluid management system 102, blender system 104, and pump systems 106 in order to monitor and/or control the operation of the entire system 100. In other embodiments, some or all of the functionality associated with the controller 152 may be located on the individual elements of the system, e.g., each of the pump systems 106 may have individual controllers that direct the operation of the associated drive systems 126 and/or power ends 122.

Figure 2A:
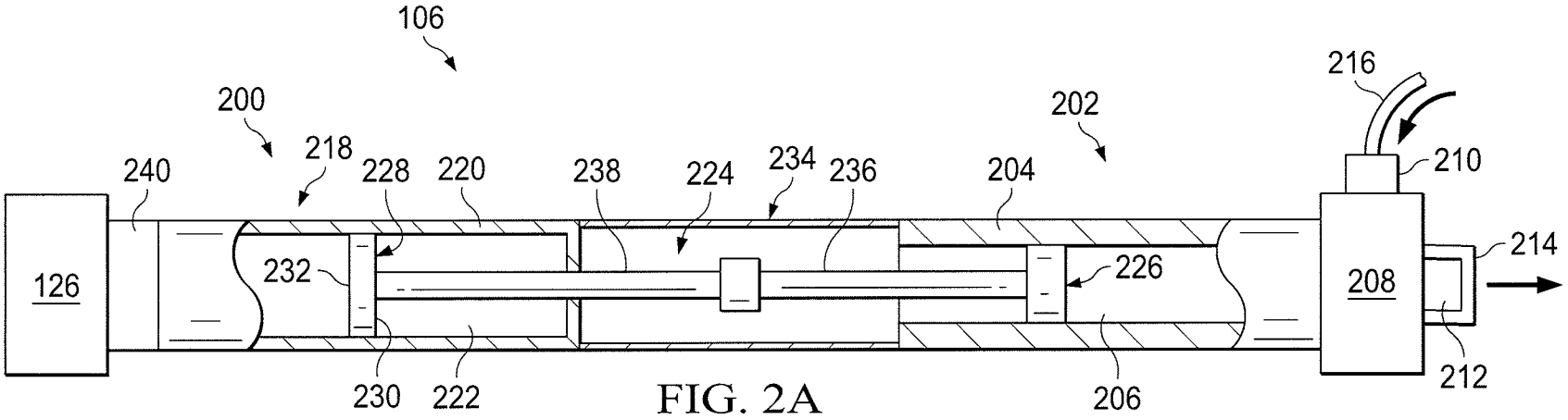
FIG. 2A is a partial cutaway side view of a decoupled long stroke pump for use in the system of FIG. 1, in accordance with an embodiment of the present disclosure.
Figure 2B:
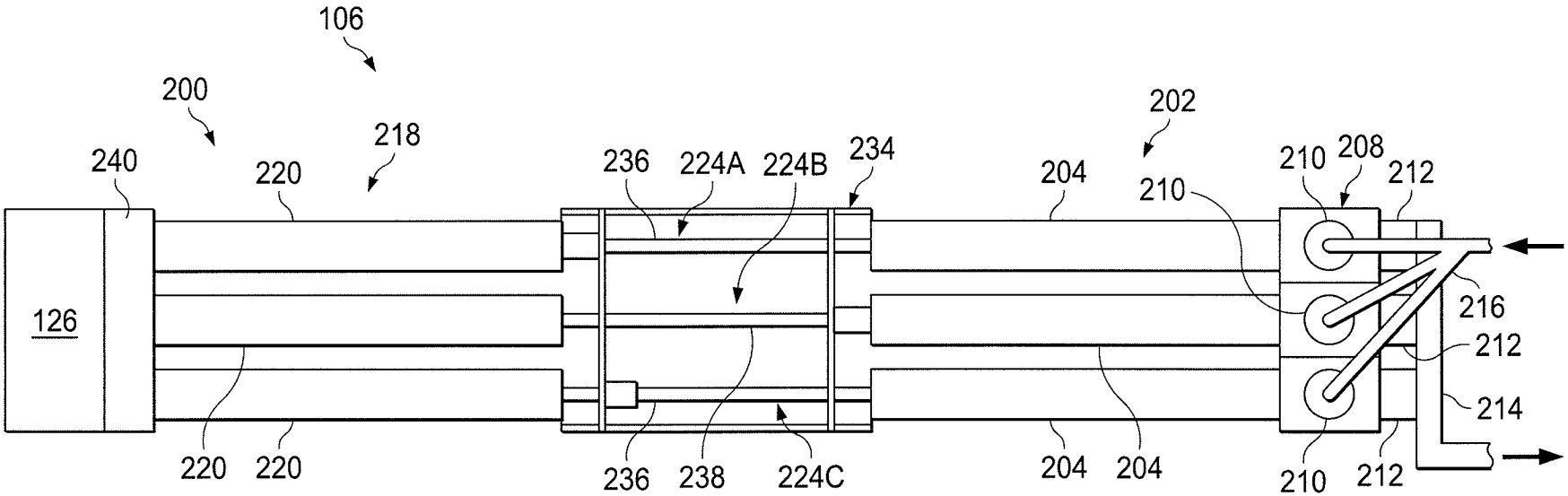
FIG. 2B is a top view of the decoupled long stroke pump of FIG. 2A, in accordance with an embodiment of the present disclosure.

FIGS. 2A and 2B illustrate an embodiment of the pump system 106 in greater detail. In the illustrated embodiment, the pump system 106 generally includes a decoupled long stroke triplex hydraulic pump 200. The pump 200 includes a fluid end assembly 202 having three substantially identical cylinders 204. Internal passages 206 of each of the fluid end cylinders 204 are in communication with corresponding valved pump cylinder heads 208, each of which is provided with a suction check valve assembly 210 and a discharge check valve assembly 212. The discharge check valve assemblies 212 communicate with a common discharge manifold 214, providing one-way fluid flow therethrough from the cylinder heads 208 into the manifold 214. The suction valve assemblies 210 communicate with a common suction header 216, providing one-way fluid flow therethrough from the suction header 216 into the cylinder heads 208. Each of the discharge check valve assemblies 212 may be continuously available to yieldably resist fluid flow into the discharge manifold 214. The yieldable resistance is particularly useful during a pre-compression phase of a pumping cycle as well as during a discharge phase.

Extending from the fluid end assembly 202, in a direction away from the pump cylinder heads 208, is a power end assembly 218. As discussed at length above, the power end may include any desired type of device for powering the linear movement of the fluid cylinders 204. In the illustrated embodiment, the power end assembly 202 utilizes hydraulic cylinders for providing linear movement of the fluid cylinders 204. In other embodiments, however, the power end may instead include roller screws or other linear long stroke mechanisms that are powered by, for example, electrical energy from the corresponding drive system.

In the illustrated embodiment, the hydraulic power end assembly 218 includes three substantially identical power cylinders 220, each having an internal passage therethrough 222. Each of these power cylinders 220 is in longitudinal alignment with one of the fluid end cylinders 204. A piston rod (or plunger) assembly 224 extends longitudinally into each power end cylinder 220 and the respective aligned fluid end cylinder 204. The ends of the plunger assemblies 224 which extend into the internal passages 206 of the fluid end cylinders 204 are provided with capped plungers 226 which function as pumping pistons. As shown in FIG. 2B, plunger assembly 224A can be at the end of a suction stroke, plunger assembly 224B can be at the end of a discharge stroke, and plunger assembly 224C may have completed a portion of a stroke. The plungers 226 are operable to bring about suction and discharge action in a conventional manner, and pre-compression action in a manner to be more fully described hereinafter.

Opposite ends (or power pistons) 228 of the plunger assemblies 224 are in sliding and sealed engagement with the walls of the internal passages 222 of the power cylinders 220. In some embodiments, power fluid may act on opposite faces 230 and 232 of the power pistons 228 to reciprocate the plunger assemblies 224.

The power end assembly 218 and the fluid end assembly 202 may be separated by a spacer frame assembly 234 which permits fluid end plunger rods 236 and power end piston rods 238 to be separate members thereby facilitating maintenance operations. The rods 236 and 238 can be hollow (except for a capped end), cylindrical members sealingly received in the fluid end internal passages 206 and the power end internal passages 222, respectively. If desired, a floating annular rod seal may be employed so as to allow the rods to operate slightly eccentric to the power cylinder bores. thereby eliminating the necessity of extremely accurate alignment between the power cylinders and the fluid end cylinders.

The drive system 126 of the pump 200 in FIG. 2 may include one or more variable stroke pumps that provide hydraulic (power) fluid to the power cylinders 220 of fixed stroke pumps that provide hydraulic (power) fluid to the power cylinders 220 via a control valve assembly 240. Various control valves 240 may direct power fluid to and from the power cylinders 220 in a manner such that the power cylinders 220 each operate on a suction, pre-compression, discharge cycle, each power cylinder 220 being out of phase with the others.

In the discharge phase of the cycle in a given power cylinder 220, power fluid acts on the outer face 232 of the power piston 228 to transmit force through the piston rod assembly 224 so as to cause the plunger 226 to move to its forwardmost stroke position whereby fluid in the cylinder head 208 is expelled through the discharge valve assembly 212 into the common discharge manifold 214. Prior to the discharge phase of the cycle, this fluid has been pre-compressed by power fluid acting on the power piston face 232 after passing through a pre-compression valve mounted on the control valve assembly 240. This pre-compression flow of power fluid causes the power piston 228, through the piston rod assembly 224, to move relatively slowly forward by an increment sufficient to compress the fluid to be pumped in the fluid end cylinder 204 and thereby raise the pressure of the fluid to approach the discharge pressure.

Suction movement of each power piston 228 is caused by power fluid acting on the inner face 230 of the power piston 228. Control valves 240 control the flowrate of the power fluid to control the suction flowrate profile.

In this manner, the suction, pre-compression and discharge functions are simultaneously and responsively performed, one function being performed in each fluid end cylinder 204. Therefore, constant pressure flow continually exists between the fluid end of the pump 200, the common suction header 216, and the common discharge manifold 214.

Figure 3:
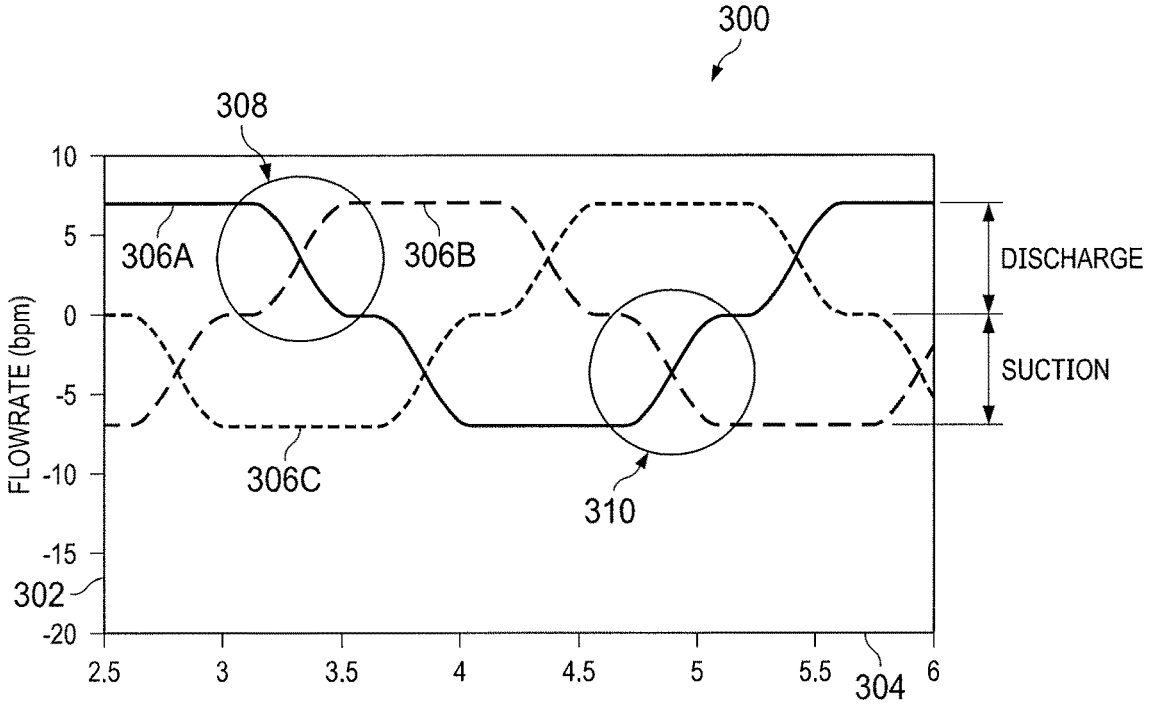
FIG. 3 is a plot illustrating discharge and suction flow rates with respect to time for a triplex decoupled long stroke pump, in accordance with an embodiment of the present disclosure.

FIG. 3 illustrates the discharge and suction flow rates from a parametric model 300 built to analyze possible configurations of a decoupled long stroke pumping system. The decoupled long stroke pump provides benefits not available through the use of existing crankshaft pumps. The model 300 plots flow rate 302 of treatment fluid (in barrel per minute, bpm) vs time 304 for each of three fluid cylinders of a triplex decoupled long stroke pump, such as pump 200 of FIGS. 2A and 2B. The three traces 306A, 306B, and 306C are representative of the flow rates for each cylinder (e.g., 204 of FIG. 2B), respectively. The trace 306A is a flowrate corresponding to a plunger that is initially pumping. As the trace 306A is slowed down at the end of its stroke, the trace 306B from the next plunger begins to increase in flow rate at the same rate that the trace 306A is decreasing in flow rate. This is a discharge transition 308 of the pump. As a result, the discharge rate stays constant at 7 bpm throughout the transition between the first and second cylinders. The same process repeats as the plunger of trace 306B slows down and the plunger of trace 306C speeds up so that 7 bpm in this case is maintained throughout the process. Tracking the trace 306A as it moves down to a negative flow rate (i.e., suction stroke), as the plunger of trace 306A increases in speed in the negative direction (more negative), the plunger of trace 306C decreases in speed in the negative direction (less negative) at the same rate that the plunger of trace 306A increases. This is a suction transition 310 of the pump. The result is also a constant 7 bpm suction rate.

Decoupling Suction and Discharge Strokes Allow Smooth, Near Ripple Free Suction and Discharge Rates Using the disclosed long stroke pump, the power end provides power to independently stroke the fluid cylinders in either direction. As such, the long stroke pump decouples the suction and discharge strokes. Decoupling the suction and discharge strokes of the pump allows the pump to operate with smooth, ripple free suction and discharge flow rates, as shown in FIG. 3. Smooth discharge rates are important because they provide minimal inertial forces on the common discharge manifold (214 of FIGS. 2A and 2B) that can cause the discharge iron to shake. The discharge iron is high pressure piping located between the pump (106 of FIG. 1) and the manifold trailer (108 of FIG. 1). Failures in the discharge iron occur due to pulsations in the flow of treatment fluid being discharged from the pump. Smooth control of the discharge flow rate, as provided in the model 300 of FIG. 3, removes such pulsations from the discharge flow, thereby reducing the occurrence of discharge iron failures.

As provided in the model 300, it is desired to utilize a triplex decoupled long stroke pump to provide a constant discharge flow rate, as compared to a duplex (i.e., having just two fluid cylinders) decoupled long stroke pump. This is because a duplex pump, while able to provide a constant discharge flow rate, cannot provide a smooth, ripple free suction flow rate at the same time. This is because, with a duplex pump, most of the time that the discharge strokes are in transition, there is little or no suction flow rate. As such, there are sudden starts and stops in the suction flow rate. Parametric modeling, along with first hand experience in the field with such pumps, has verified that problems occur in such systems due to the inconsistent suction flow rate. Specifically, every time one of the two plungers gets to the end of a suction stroke, it creates a water hammer that blows some fluid out of the top of the blender assembly. For these reasons, it is desirable to utilize at least a triplex decoupled long stroke pump, instead of a duplex pump (unless that duplex pump is a double acting duplex pump, as described in greater detail below).

Figure 4:
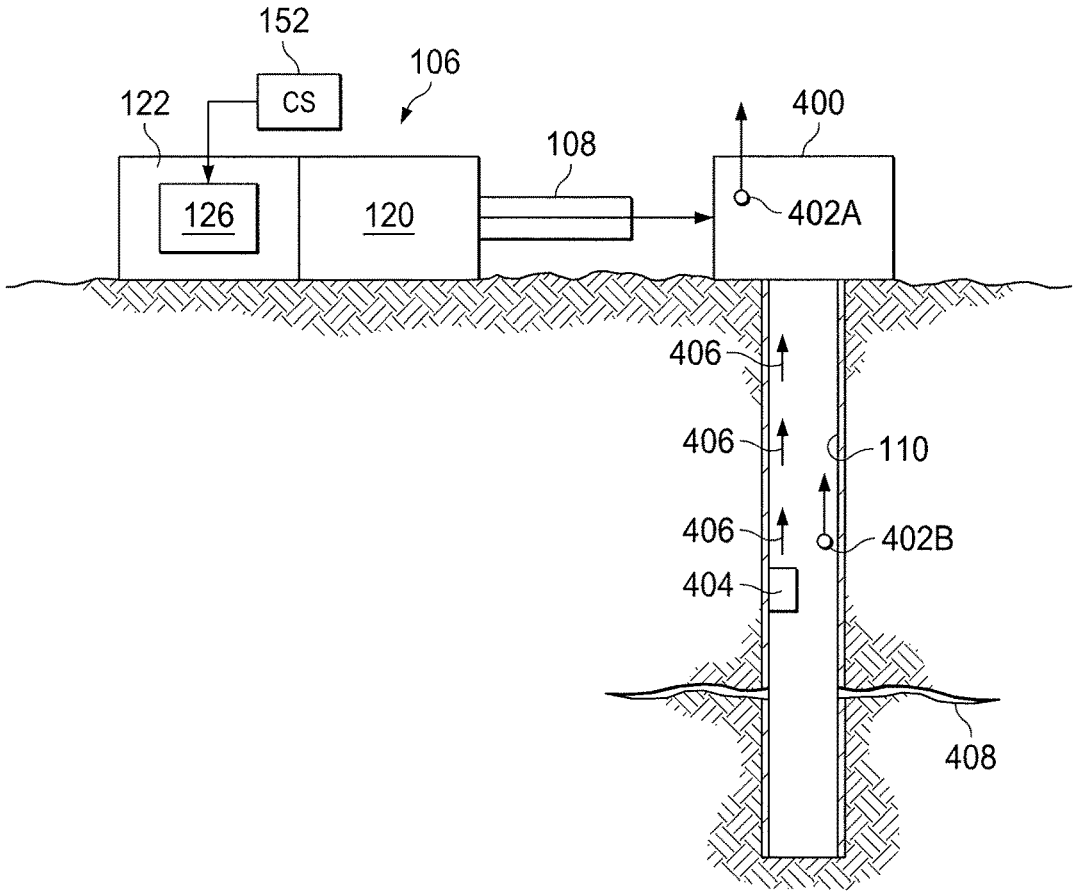
FIG. 4 is a schematic diagram of a well system utilizing a decoupled long stroke pump and pressure sensors for detecting various pressure measurements or signals within the system, in accordance with an embodiment of the present disclosure.

The decoupled long stroke pump also provides better overpressure control than existing crankshaft pumps. FIG. 4 illustrates a system for providing overpressure control of the decoupled long stroke pump 106. The system includes the pump 106 fluidly coupled to a wellhead 400 located at a surface of the wellbore 110. The system includes one or more pressure sensors 402 as well, located within the wellhead 400 (sensor 402A), downhole in the wellbore 110 (sensor 402B), or both. The control system 152 outputs control signals for operating the drive system 126 and/or power end 122 of the pump 106 in response to pressure detected by one or more of the pressure sensors 402. To that end, the control system 152 is communicatively coupled to the pressure sensor(s) 402 via a wired or wireless communication medium.

To provide overpressure control, the control system 152 receives pressure signals from one or more pressure sensors 402 at the well site. The control system 152 is configured to send one or more control signals to the pump 106 to shut down the pump 106 in response to receiving a pressure signal from the sensor(s) 402 that is above a predetermined treatment fluid pressure threshold. This prevents the pumps 106 from pumping fluid into the wellbore 110 at too high of a pressure. Another layer of overpressure control is provided by the control system 152 limiting the hydraulic power pressure such that there is not sufficient driving force to generate a pressure above the pressure limit on the fluid end of the pump.

Since the decoupled long stroke pump 106 provides smooth, nearly ripple free discharge flow rates of the treatment fluid pumped therethrough, the pump 106 provides better overpressure control than is available through crankshaft pumps or duplex long stroke pumps. This is because the consistent discharge flow rates offered through the pump 106 will leave the measured pressure signals relatively free of noise. When using crankshaft pumps, on the other hand, there is enough pressure noise due to fluctuations in the discharge flow rates that either the detected pressure signals must be highly filtered (as the signal-to-noise ratio is low), or the maximum pressure threshold must be set to a few hundred psi above the actual maximum pressure, to minimize or prevent random pressure spikes from shutting down the pump. Using the disclosed pump systems 106, the pressure signals will have a much higher signal to noise ratio due to the lack of random pressure spikes in the discharge flow rate.

The smooth discharge flow rate will also help to increase the signal to noise ratio of any downhole generated pressure pulses that provide information about downhole conditions. FIG. 4 illustrates a pressure pulse communication system 404 disposed downhole in the wellbore 110 and used to output communications via pressure pulses 406 to an uphole pressure sensor (e.g., pressure sensor 402A in the wellhead 400). The pressure pulses 406 may contain information about one or more downhole conditions, such as an operational status of a downhole tool, a wellbore characteristic, a fracture characteristic, or data indicative of the growth of downhole fractures 408. The pressure sensor 402A may communicate signals indicative of the detected pressures to the control system 152, and the control system 152 may interpret the pressure signals to determine the downhole properties communicated via pressure pulses to the surface. Pressure data related to these measured downhole properties is easier to discriminate from other bulk pressure data collected by the sensors 402 due to the lack of noise in the pressure signals from spikes in the discharge flow rate from the pump 106.

Figure 5:
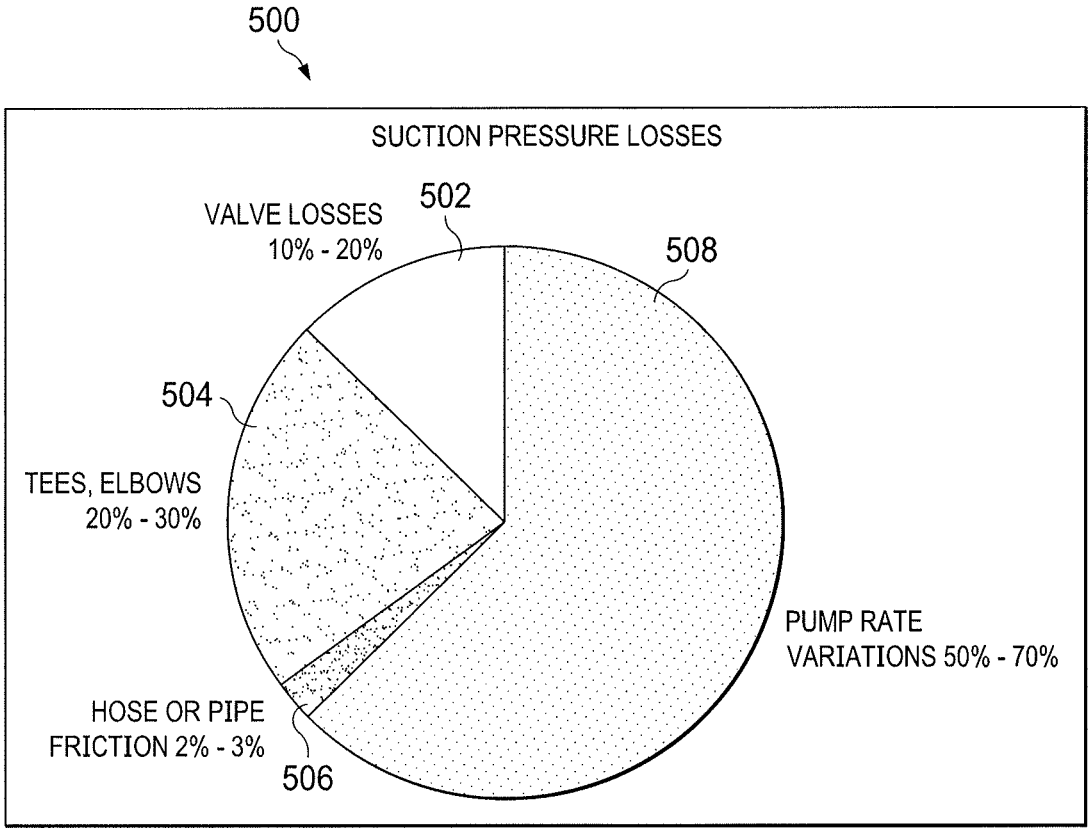
FIG. 5 is a pie chart illustrating different sources of pressure losses at a suction end of a pump system, in accordance with an embodiment of the present disclosure.

FIG. 5 is a pie chart 500 that illustrates the importance of maintaining a constant suction rate at the high pressure pumps used to deliver fluid treatments to the wellbore. The pie chart 500 shows the various causes of pressure loss from the blender (104 of FIG. 1) to the downhole pump (106 of FIG. 1) when crankshaft pumps are used, and the proportion of the total pressure drop contributed by each cause. As shown, pressure losses at valves 502 account for approximately 10% to 20% of the overall suction pressure loss of the system; pressure losses at tees and elbows 504 within the manifolding account for approximately 20% to 30% of the overall suction pressure loss; hose or pipe friction 506 accounts for approximately 2% to 3% of the overall suction pressure loss; and variations in pump rate 508 at the suction end of the pump accounts for approximately 50% to 70% of the overall suction pressure loss. This 50% to 70% of the pressure loss from the blender to the downhole pump suction occurs in a relatively short (e.g., 10 feet long, 4 inch internal diameter) hose (124 of FIG. 1) connecting the pump (106 of FIG. 1) to the manifold (108 of FIG. 1). This pressure drop between the blender and the pump (specifically in the hose between the manifold trailer and the pump) is due to fluid acceleration from the flow profile via a crankshaft pump.

The present embodiments are directed to using decoupled long stroke pumps, as opposed to crankshaft pumps, and the long stroke pump provides a steady flow rate through the suction of the pump as discussed at length above. This constant flow rate at the suction leads to a much lower pressure drop than is available using crankshaft pumps. The lower pressure drop from having a steady flow means that the decoupled long stroke pump can pump without cavitation at rates 50% to 70% higher than the rates of crankshaft pumps. Another option is to run the decoupled long stroke pumps at the same pressure as comparable crankshaft pumps while reducing fatigue cycles on the fluid ends due to the longer stroke.

The following Equation 1 shows that the pressure losses due to inertance of fluid is a function of the rate of change of the suction flowrate.

$$\text{pressure drop} = \frac{dQ}{dt} \times \frac{\rho L}{A} \qquad \text{Equation (1)}$$

where dQ/dt is the rate of change of the flowrate, p is fluid density, L is the length of the hose or tube, and A is the cross-sectional area of the hose or tube. Thus, having an absolute constant flowrate on the suction side of the pump is important to minimizing the pressure drop between the blender and the pump.

Since at least 50% of the pressure drop occurs from inertance in the suction hose, an absolute constant flowrate provided by the decoupled long stroke pump will allow the system to pump at double the flow rate with a similar pressure drop as a crankshaft pump, or the same flow rate with half the pressure drop (and lower fatigue on the fluid end). This leads to more efficient operation of the fluid treatment system than is available using crankshaft pumps, or operation of the fluid treatment system with fewer interruptions due to maintenance being performed on the fluid ends.

Turning back to FIG. 1, another result of using decoupled long stroke pumps in a treatment fluid system (as opposed to crankshaft pumps) is that each configuration of the pumps 106/manifold 108 responds the same. In systems using crankshaft pumps, pulsations from individual pumps act as a forcing function for pump/manifold resonances. As a result, the pumping configuration on one location may experience no problems while a slightly different configuration of the pumps and manifold at another location may experience severe pressure pulsations and line movement. Using the decoupled long stroke pumps 106, as disclosed herein, reduces or eliminates pressure pulsations during pumping, due to the smooth suction and discharge rates. As such, the system does not cause a forcing function from pump pulsations, meaning that each configuration of the pumps 106 and manifold 108 will respond the same with little or no pressure pulses or vibrations.

Since the pumps 106 have little or no pressure pulsations, pump flowrates do not have to be offset to prevent beat frequencies that might otherwise negatively impact pump suction characteristics. Such beat frequencies are caused when the frequencies of two sinusoids do not perfectly line up, and the closer the frequencies are to each other the longer the resulting pressure pulsations are added to each other. Since the decoupled long stroke pumps 106 are not subject to pressure pulsations, unlike crankshaft pumps, there is no need to operate the pumps at different flowrates. Instead, the decoupled long stroke pumps 106 may each be operated to pump fluid at the same flowrate.

Decoupled Long Stroke Pumps Provide Absolute Control of Treating Pressure and Flow Rate Because of the smooth, ripple free discharge rates available using the disclosed long stroke pumps 106, the well treatment system 100 can operate with absolute control over the pressure and flow rate of treatment fluid pumped to the wellbore 110. Since the pressure and flow rate can be controlled so accurately, the decoupled long stroke pumps 106 can be used for pressure pulse stimulation, or any other desired mode of well stimulation requiring a custom flow rate and/or pressure profile.

When using a group of crankshaft pumps to pump treatment fluid to a wellbore, there are many different harmonics to accommodate that make it difficult to generate custom pressure or flow rate profiles. It is especially difficult to maintain a custom pressure profile using crankshaft pumps if the overall treating rate varies. Absolute control of the treating pressure and/or flow rate, which is available using the decoupled long stroke pumps 106, allows pressure pulse stimulations to be performed on the wellbore. Pressure pulse stimulation is both easier to accomplish and results in less wear on the pumping equipment than would be possible without an absolute control of the pump discharge.

Crankshaft pumps also experience gear shifts that affect the discharge flowrate of the pumps during operation. In contrast, the disclosed decoupled long stroke pumps 106 do not have transmissions, and therefore no gear shifts are necessary for operating the pumps 106. No gear shifts mean no undesired effects on the discharge flowrate during operation of the pumps 106, so that the decoupled long stroke pumps 106 provide better control of the discharge flowrate. No gear shifts also better allows for constant pressure fracturing of the wellbore 110, as there is no point where the pump 106 goes off for a short amount of time (e.g., during a gear shift) as is the case with crankshaft pumps.

Figure 6:
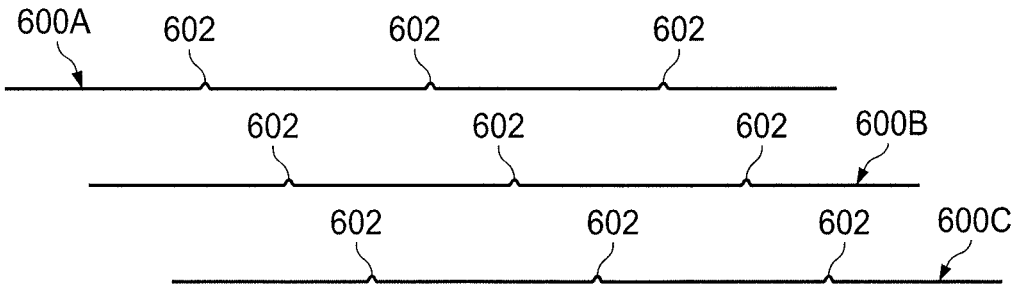
FIG. 6 is a plot illustrating flow rates of three decoupled long stroke pumps that are offset with respect to a common timing pulse, in accordance with an embodiment of the present disclosure.

The stroke cycles of each pump 106 within the treatment system 100 may be controlled to increase the degree of control over the final flowrate of treatment fluid being pumped to the wellbore 110. Specifically, the pumps 106 may be controlled so that their cycles are offset with respect to each other from a common timing pulse to minimize the effect of any pulsations from individual pumps on the overall output flowrate. FIG. 6 illustrates the operation of multiple decoupled long stroke pumps that are offset from a common timing pulse. FIG. 6 shows three traces 600 representing a discharge flowrate taken with respect to time (left to right). Each trace 600A, 600B, and 600C represents the flowrate of a different decoupled long stroke pump (e.g., 106 of FIG. 1) used to pump treatment fluid to a wellbore. The three pumps are operated at the same time to provide the treatment fluid to the wellbore. However, the stroking of each of the three pumps is offset with respect to a common timing pulse. That is, one pump may begin stroking (600A), a second pump may then begin stroking (600B) at a time that is offset from the beginning of the stroke of the first pump, and a third pump may then begin stroking (600C) at a time that is offset from both the beginning of the stroke of the second pump and the beginning of a second stroke of the first pump. This specific timing of the pump operations may be controlled via the control system 152 of FIG. 1. While flowrates for only three pumps are shown in FIG. 6, it should be noted that other numbers of pumps may have their pump strokes offset from each other in a similar manner.

By offsetting the timing of the strokes from different pumps within the overall wellbore treatment system, the method allows for elimination of any issues with small pulses in the pumping flowrates. For example, if there are any problems in maintaining the slowdown of one plunger of a decoupled long stroke pump at the same rate as the speed up of the next plunger of the decoupled long stroke pump, then there could be a slight pulse 602 in the flowrate 600 resulting from the pump. Such minor pulses 602 are shown within each trace 600 of flowrates in FIG. 6. Offsetting the strokes of all decoupled long stroke pumps (3 in this case) ensures that the pulses will not be additive, or form beats that interfere more with the desired constant flowrate or pressure from the treatment system.

To counter these small flowrate variations 602 during the transitions from different plungers providing the flow rate, all decoupled long stroke pumps may work from a common timing pulse. Each pump's cycle will be offset such that if a small pulse 602 occurs during the plunger transition, there will not be two of them (from different pumps) that could occur at the same time (or near the same time) to cause a beat frequency in the flowrate output. This minimizes the effect of any individual pulses within the flowrate so as to keep the overall flowrate of the multi-pump system relatively constant.

The absolute control of treating pressure and flowrate afforded using decoupled long stroke pumps also provides enhanced overpressure control for the treatment system. Turning again to FIG. 4, overpressure control refers to limiting the input pressure of fluid at the pump 106 to a value that will not allow the output pressure (e.g., as measured by a pressure sensor 402) of treatment fluid to go above a predetermined threshold for maximum treating pressure. For example, if an input fluid pressure of 5,000 psi leads to an output pressure at 10,000 psi, and 10,000 psi is the maximum treating pressure, then the control system 152 would operate the pump 106 to maintain the input side at 5,000 psi or less. Such pressure control at the input is straightforward with the decoupled long stroke pump. The control system 152 would operate a pressure override valve in the variable stroke hydraulic pumps to cause them to de-stroke when the pressure limit is reached. A second layer of protection is provided by a cross-port relief that will relieve the pressure from the pump if the pressure exceeds the maximum pressure desired. In crankshaft pumps, such overpressure control requires controlling the speed of the crankshaft, and doing so requires absorption of a certain amount of pressure due to inertia. The decoupled long stroke pump 106 of current embodiments has low inertia compared to crankshaft pumps. As a result, during an overpressure situation, the long stroke pump 106 will be less prone to additional overpressure from inertia, as compared to crankshaft pumps.

The disclosed decoupled long stroke pump also allows for a reduction in the time to pressure test the pump 106 as compared to crankshaft pump systems. Turning back to FIGS. 2A and 2B, during a pressure test of the decoupled long stroke pump 106, the drive system 126 would be force limited such that all plungers 226 would stroke within their fluid cylinders 204 at the same time. The stroking of these cylinders 204 stops when the pressure of the output fluid (detected by sensors e.g., 402 of FIG. 4) matches the desired output pressure corresponding to the input force. Since the strokes of the different fluid cylinders 204 are decoupled, the cylinders 204 can all be stroked together and pressure tested simultaneously, thereby reducing the overall time to pressure test the pumps 106.

The decoupled long stroke pump 106 also provides for more accurate pressure testing than can be achieved via crankshaft pumps. This is because there is not a difference in pressure between each of the cylinders depending from the crankshaft being at different angles during pressure testing. In crankshaft pumps, the torque changes with respect to position of the crankshaft, and the discharge pressure of crankshaft pumps is related to the torque. In present embodiments, however, the decoupled long stroke pump 106 does not rely on any crankshaft to move the plungers 226, and therefore the decoupled long stroke pump 106 provides absolute pressure control during the pressure test. As a result of this absolute pressure control, there is no chance of overshooting the desired output pressure during the pressure test of the decoupled long stroke pump 106.

Pre-Compression

As mentioned above with reference to FIGS. 2A and 2B, the decoupled long stroke pump 106 may be controlled such that the cylinders each operate on a suction, pre-compression, discharge cycle, each cylinder 204 being out of phase with the other two. The pre-compression phase of the cycle involves compressing liquid and any entrained gases that are in the liquid in the fluid end 202 and expanding the fluid end so that the fluid cylinder 204 is ready for the start of the discharge (pumping) portion of the cycle. The plunger 226 is pushed forward until the liquid and gases in the cylinder 204 are pre-compressed and fluid end is expanded such that the the cylinder 204 is ready for pumping.

If there is some cavitation or other issue that reduces the total volumetric efficiency of the cylinder 204, then pre-compression prior to pumping from the cylinder 204 will collapse the vapor bubbles, compress the fluid in the cylinder 204, and expand the fluid end to be ready to start pumping as soon as the cylinder 204 starts forward.

In a crankshaft pump since the cylinders are not decoupled from each other, if there is cavitation, then the plunger is building speed as bubbles collapse, and once all the bubbles are collapsed the plunger collides with fluid treating pressure at a velocity instead of starting from zero. This results in a sudden flowrate and pressure pulse from the pump. This results in sudden flowrate pulses and their associated pressure pulses in the discharge line, impact loading on the drive system, and loss of pump rate even though the crankshaft is turning at the same speed. In present embodiments, however, the decoupled long stroke pump 106 allows for controlling the plunger speed to slowly compress vapor until the fluid end is expanded. This amounts to a "soft compression", or pre-compression. When all the vapor is slowly compressed to liquid in the cylinder, then the load on the plunger is no more than while the plunger is moving at full speed.

If some of the plunger length is kept in reserve on the long stroke pump 106, then part of the reserve length can be used to compensate for a loss of efficiency in the long stroke pump 106. There is no need to adjust the stroke speed to make up the difference.

Pump Diagnostics

The decoupled long stroke pump 106 may be outfitted with sensors in various positions within the pump, and these sensors may be used to perform diagnostics on the pump operations. Such sensors can be used, for example, to determine a volumetric efficiency of the pump or to detect leakage at the either the suction valve or the discharge valve.

Figure 7:
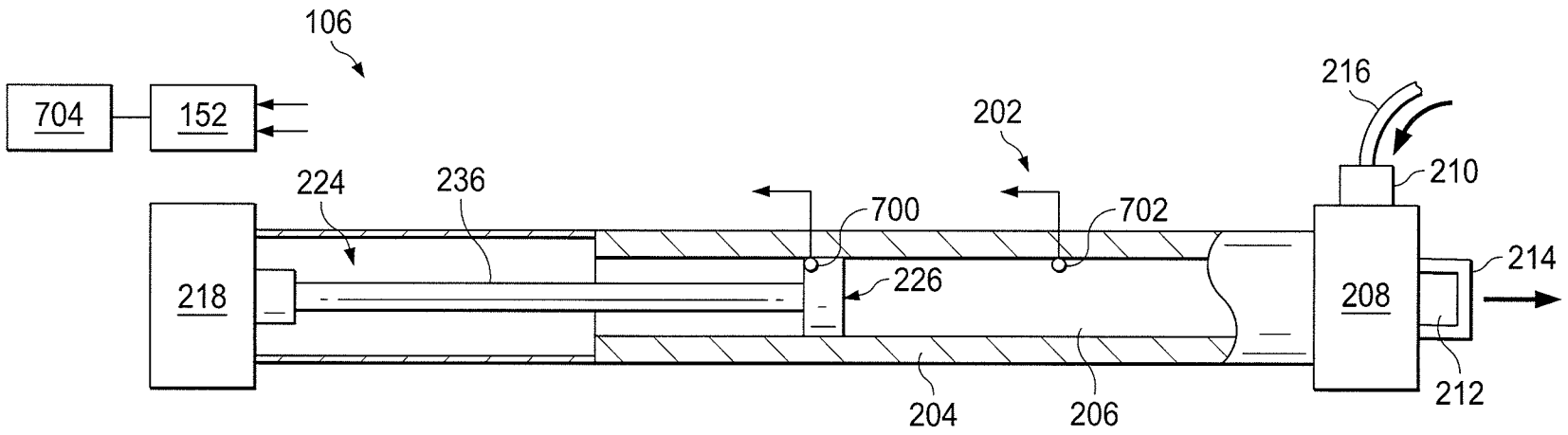
FIG. 7 is a partial cutaway side view of a decoupled long stroke pump equipped with sensors for performing diagnostics on the pump, in accordance with an embodiment of the present disclosure.

FIG. 7 illustrates an embodiment of the decoupled long stroke pump 106 that is equipped with sensors to provide various pump diagnostics. Although two sensors are shown in the illustrated embodiment, it should be noted that other embodiments may include just one of these sensors, or three or more sensors. The sensors are shown in a partial cutaway view of the long stroke pump 106 showing just one of three pump cylinders. The other pump cylinders (not shown) may be equipped with the same combination of sensors 700 and 702, so that the diagnostics performed are specific to each pump cylinder. The sensors may include a position sensor 700 disposed on a portion of the piston rod assembly 224 (e.g., on the plunger 226) and a pressure sensor 702 disposed within the fluid end cylinder 204. Both sensors 700 and 702 may be communicatively coupled to the control system 152, which may perform calculations on the sensor feedback to determine various diagnostics about the pump 106. The diagnostic results can then be output to an operator via a display 704 or some other I/O device.

The position sensor 700 may detect a longitudinal position of the piston rod assembly 224 (or more specifically, the plunger 226) within the long stroke pump 106. The measured longitudinal position can be used, among other things, to confirm the relative position of the plunger 226 within the cylinder 204 and therefore the phase of operation of that cylinder 204 (i.e., suction, discharge, or pre-compression). This may be compared to a desired position/phase of operation for that cylinder 204 as predetermined by the controller 152. The position measurements taken by the sensor 700 during the pre-compression phase may be analyzed to determine a volumetric efficiency of the cylinder 204 in real-time or near real-time.

The position sensor 700 may also be utilized to detect any leakage through the suction valve 210 corresponding to that cylinder 204. Any continued movement of the plunger 226 during the pre-compression phase, instead of stopping after the slurry has been pre-compressed to just below treating pressure, may indicate leakage through the suction check valve assembly 210. If the plunger 226 continues to creep forward after pre-compression is completed, the sensor 700 may detect this additional movement, and the control system 152 may output a warning indication to an operator (e.g., via the operator interface 704) informing them that the suction valve 210 is leaking.

The pressure sensor 702 may be utilized to detect any leakage through the discharge valve 212 corresponding to that cylinder 204. Any increase in pressure within the cylinder 204 after the suction stroke is complete but prior to the pre-compression phase may indicate leakage through the discharge check valve assembly 212. If the pressure in the cylinder 204 continues to climb after the suction is completed, the sensor 702 may detect this increase in pressure, and the control system 152 may output a warning indication to an operator (e.g., via the operator interface 704) informing them that the discharge valve 212 is leaking.

Because the stroking of the different cylinders 204 in the pump 106 are decoupled, the sensors 700 and 702 in each of the cylinders are able to provide meaningful data to the control system 152 for diagnosing leaks within specific suction/discharge valves.

Improvements with Hydraulics

Turning back to FIGS. 1, 2A, and 2B, the disclosed decoupled long stroke pump also provides various improvement for hydraulic control of the treatment fluid pumping process. For example, using multiple variable stroke hydraulic pumps 106 provides both fine and coarse control of the pressure output from the entire pumping system, as compared to a system where only one large hydraulic pump is used. The decoupled long stroke pumps 106 can be controlled to operate within an acceleration profile that will minimize the load on pump bearings and slipper shoes between the pistons and the swash plate, which could otherwise lead to metal-to-metal wear.

At the end of a discharge stroke (224B of FIG. 2B), the drive side of the plunger 226 is still under pressure. This energy may be recovered by a slight reverse stroke of the variable stroke hydraulic pump 106, causing it to now act as a motor until the hydraulic fluid is decompressed on the drive side. This will reduce heating that would otherwise occur if this pressure were simply bled off through a valve. In this manner, the pump 106 will only produce as much pressure as needed. The use of variable stroke hydraulic pumps 106 reduces the heating within the pump system as they can be controlled to provide only the fluid that is needed at the time, as opposed to a proportional or servo valve that controls flowrate through a pressure drop.

Figure 8:
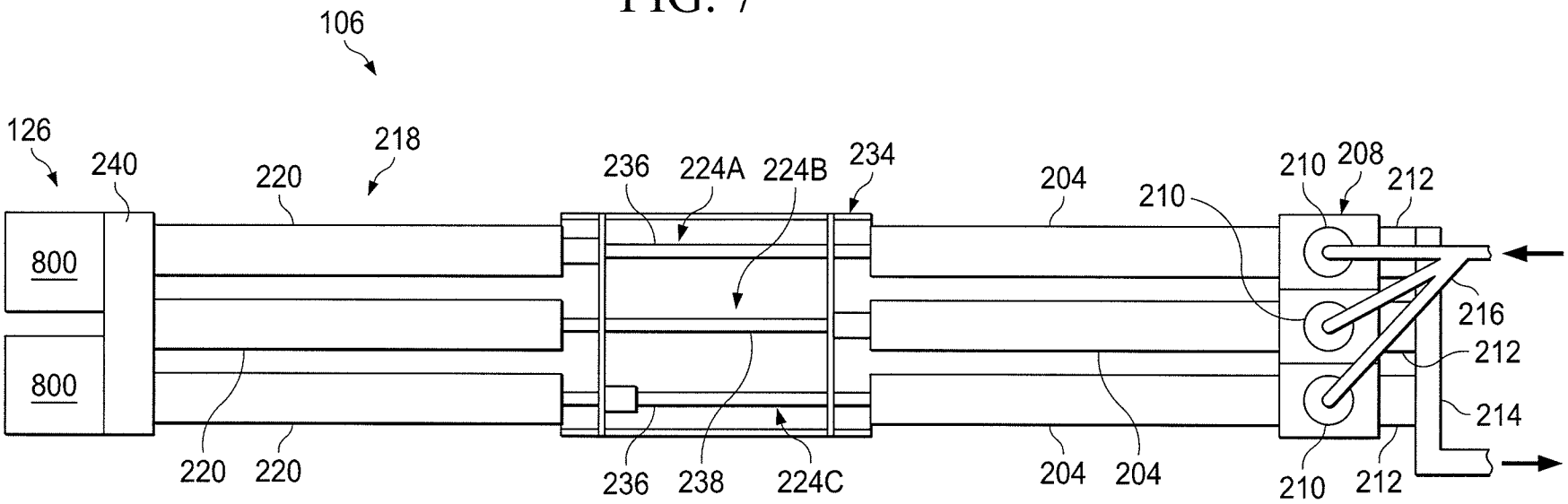
FIG. 8 is a top view of a triplex decoupled long stroke pump that receives pumping power from two hydraulic power pump systems within one hydraulic pumping system, in accordance with an embodiment of the present disclosure.

FIG. 8 shows a block diagram of an embodiment of the decoupled long stroke pump 106 that includes three plungers 226 and only two hydraulic power sources 800. Just two hydraulic power sources 800 may be used to operate the pump 106 since the pump 106 is only pumping fluid through two cylinders 204 at any one time.

Figure 9:
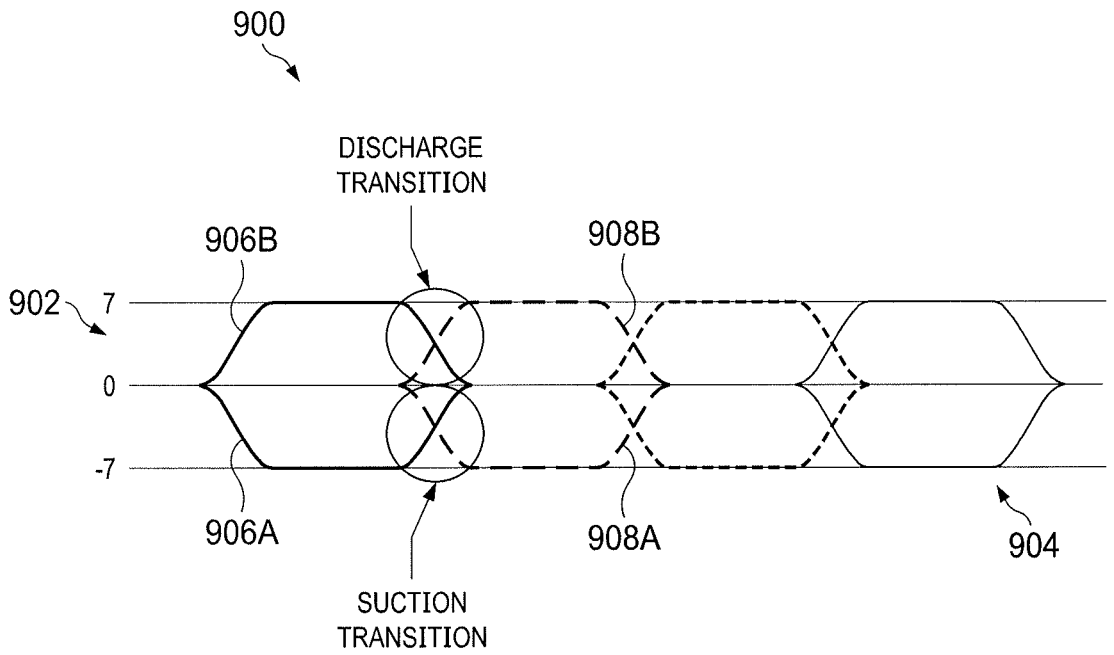
FIG. 9 is a plot illustrating discharge and suction flow rates with respect to time for a duplex double-acting long stroke pump, in accordance with an embodiment of the present disclosure.

Another embodiment of a long stroke pump used in fluid treatment operations may involve coupling the suction and discharge of a double-acting pump having two or more plungers. The double acting long stroke pump would have a power source in the middle of the plunger with a fluid end on both ends of the plunger, as opposed to the above described decoupled long stroke pump. FIG. 9 shows flow characteristics of such a double-acting pump. Specifically, FIG. 9 illustrates the discharge and suction flow rates from a parametric model 900 built to analyze possible configurations of a double-acting long stroke pumping system. The model 900 plots flow rate 902 of treatment fluid (in barrel per minute, bpm) vs time 904 for each of two fluid cylinders of a duplex double acting long stroke pump. Even without decoupling the suction and discharge, a constant flow rate at the suction and discharge would be possible, but would not be as flexible in operation as being able to have different profiles on the suction and discharge strokes. In FIG. 9, two traces 906A and 906B represent the suction and discharge flowrates, respectively, of a first plunger of the pump, while two traces 908A, and 908B represent the suction and discharge flowrates, respectively, of a second plunger of the pump. As one end of the first plunger is on a discharge stroke (906B) with a positive flowrate, the other end of the plunger is on a suction stroke (906A) with a negative flowrate. Similarly, as one end of the second plunger is on a discharge stroke (908B) with a positive flowrate, the other end of the plunger is on a suction stroke (908A) with a negative flowrate. As the discharge rate 906B of the first plunger decreases, the discharge rate 908B of the second plunger is increasing such that the flowrate is constant on both the suction and discharge. This process repeats itself until the first plunger is pumping again (906B), but the next time, the previous end that was in the suction stroke now becomes the discharge stroke, and vice versa.

In summary, using decoupled long stroke pumps to pump treatment fluid down a wellbore offers improvements over previously used crankshaft pumps. First, the decoupled long stroke pumps result in lower maintenance costs for fluid ends, as they provide a much longer stroke length which reduces the number of pressure cycles on the fluid ends. The decoupled long stroke pumps are able to pump at higher pressures with lower cost delivery. Decoupled long stroke pumps have the potential for longer pump uptime compared to crankshaft pumps, thereby requiring fewer standby pumps to replace ones that are taken offline. Decoupled long stroke pumps require less boost pressure from the blender, which will improve blender life and uptime. In addition, and as discussed at length above, decoupled long stroke pumps provide the following: absolute control of flowrate and pressure; custom flow and pressure profiles; more fracture information due to a better signal to noise ratio on pressure data; faster pressure tests and overpressure shutdowns; reduced discharge iron vibration and movement; and no issues with coming on line.

Embodiments disclosed herein include:

A. A method including pumping treatment fluid to a wellbore via a long stroke pump including a fluid end and a power end, wherein the long stroke pump includes three fluid cylinders within the fluid end, wherein the power end powers the movement of three plungers, each of the three plungers located within a corresponding one of the three fluid cylinders, wherein the movement of the plungers within their corresponding fluid cylinders is decoupled, wherein pumping the treatment fluid includes: urging the treatment fluid through a suction line into the fluid end via movement of one or more of the plungers; and pressurizing and outputting the treatment fluid to the wellbore through a discharge line in response to movement of one or more of the three plungers; and controlling the long stroke pump to maintain a constant flowrate through the suction line during pumping of the treatment fluid.

B. A method including pumping treatment fluid to a wellbore via a long stroke pump including a fluid end and a power end, wherein the long stroke pump includes three fluid cylinders within the fluid end, wherein the power end powers the movement of three plungers, each of the three plungers located within a corresponding one of the three fluid cylinders, wherein the movement of the plungers within their corresponding fluid cylinders is decoupled, wherein pumping the treatment fluid includes stroking each of the three plungers within their respective fluid cylinders through a three-phase cycle, wherein the three-phase cycle includes: a suction phase whereby the plunger is moved backward in the fluid cylinder to draw treatment fluid into the fluid cylinder from a suction line; a pre-compression phase whereby the plunger is moved slowly forward in the fluid cylinder in an increment sufficient to compress the treatment fluid and expand the fluid end; and a discharge phase whereby the plunger is moved quickly forward in the fluid cylinder to discharge the treatment fluid from the fluid cylinder under pressure to a discharge line Each of the embodiments A and B may have one or more of the following additional elements in combination: Element 1: further including measuring a pressure of the treatment fluid within the wellbore or at a wellhead leading to the wellbore, via a pressure sensor. Element 2: further including: while operating the long stroke pump, outputting pressure pulses from downhole equipment within the wellbore or from fracture initiation and growth; detecting the pressure pulses via a pressure sensor disposed in a wellhead leading to the wellbore; and interpreting the detected pressure pulses via a control system to determine characteristics of the wellbore. Element 3: further including: pumping treatment fluid to the wellbore via a plurality of decoupled long stroke pumps including the long stroke pump; and controlling operation of the plurality of decoupled long stroke pumps to output a combined flow of treatment fluid to the wellbore. Element 4: further including controlling operation of the plurality of decoupled long stroke pumps such that the combined flow of treatment fluid to the wellbore has a constant flowrate. Element 5: further including controlling operation of the plurality of decoupled long stroke pumps such that the combined flow of treatment fluid to the wellbore has a dynamic flow rate that conforms to a custom profile. Element 6: further including performing pressure pulse stimulation on the wellbore via the treatment fluid output from the plurality of decoupled long stroke pumps. Element 7: further including controlling operation of the plurality of decoupled long stroke pumps such that the stroking of plungers within their corresponding fluid cylinders in each of the decoupled long stroke pumps is offset from each of the other decoupled long stroke pumps with respect to a common timing pulse. Element 8: further including performing a pressure test on each of the three plungers within their corresponding cylinders simultaneously. Element 9: wherein the power end includes a drive system, wherein the drive system is selected from the group consisting of: one or more engines powering pumps, an electric motor, and an electric driven force actuator. Element 10: wherein the power end strokes the cylinders via hydraulics, electric linear motors, roller screws, or long stroke linear mechanisms. Element 11: wherein the power end includes only two hydraulic power sources for powering independent movements of the three plungers within their corresponding cylinders.

Element 12: further including measuring a position of each of the plungers via position sensors and determining, based on the measured position of each of the plungers, a volumetric efficiency for each of the three fluid cylinders. Element 13: further including measuring a position of each of the plungers via position sensors and determining, based on the measured position of each of the plungers during the pre-compression phase, a presence of leakage in a suction valve at the suction line. Element 14: further including measuring a pressure within each of the fluid cylinders via pressure sensors and determining, based on the measured pressure of each of the fluid cylinders after the suction phase but prior to the pre-compression phase, a presence of leakage in a discharge valve at the discharge line. Element 15: further including recovering energy from a drive side of each of the plungers after completing the discharge phase. Element 16: further including controlling the long stroke pump to maintain a constant flowrate through the suction line during pumping of the treatment fluid. Element 17: wherein the power end includes a drive system, wherein the drive system is selected from the group consisting of: one or more engines powering pumps, an electric motor, and an electric driven force actuator. Element 18: wherein the power end strokes the cylinders via hydraulics, electric linear motors, roller screws, or long stroke linear mechanisms.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. Consequently, the disclosure is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method, comprising:

pumping treatment fluid to a wellbore via a long stroke pump comprising a fluid end and a power end, wherein the long stroke pump comprises three fluid cylinders within the fluid end, wherein the power end powers the movement of three plungers, each of the three plungers located within a corresponding one of the three fluid cylinders, wherein the movement of the plungers within their corresponding fluid cylinders is decoupled, wherein pumping the treatment fluid comprises:

controlling, by a control system, the stroking of the three plungers within the corresponding fluid cylinders with respect to a common timing pulse, and wherein the common timing pulse determines a known position in each stroke for each of the three plungers;

urging the treatment fluid through a suction line into the fluid end via movement of one or more of the plungers; and pressurizing and outputting the treatment fluid to the wellbore through a discharge line in response to movement of one or more of the three plungers; and controlling the long stroke pump to maintain a constant flowrate through the suction line during pumping of the treatment fluid.

2. The method of claim 1, further comprising measuring a pressure of the treatment fluid within the wellbore or at a wellhead leading to the wellbore, via a pressure sensor.

3. The method of claim 1, further comprising:

while operating the long stroke pump, outputting pressure pulses from downhole equipment within the wellbore or from fracture initiation and growth;

detecting the pressure pulses via a pressure sensor disposed in a wellhead leading to the wellbore; and interpreting the detected pressure pulses via the control system to determine characteristics of the wellbore.

4. The method of claim 1, further comprising:

pumping treatment fluid to the wellbore via a plurality of decoupled long stroke pumps including the long stroke pump; and controlling operation of the plurality of decoupled long stroke pumps to output a combined flow of treatment fluid to the wellbore.

5. The method of claim 4, further comprising controlling operation of the plurality of decoupled long stroke pumps such that the combined flow of treatment fluid to the wellbore has a constant flowrate.

6. The method of claim 4, further comprising controlling operation of the plurality of decoupled long stroke pumps such that the combined flow of treatment fluid to the wellbore has a dynamic flow rate that conforms to a custom profile.

7. The method of claim 6, further comprising performing pressure pulse stimulation on the wellbore via the treatment fluid output from the plurality of decoupled long stroke pumps.

8. The method of claim 4, further comprising controlling operation of the plurality of decoupled long stroke pumps such that the stroking of plungers within their corresponding fluid cylinders in each of the decoupled long stroke pumps is offset from each of the other decoupled long stroke pumps with respect to the common timing pulse.

9. The method of claim 1, further comprising performing a pressure test on each of the three plungers within their corresponding cylinders simultaneously.

10. The method of claim 1, wherein the power end comprises a drive system, wherein the drive system is selected from the group consisting of: one or more engines powering pumps, an electric motor, and an electric driven force actuator.

11. The method of claim 1, wherein the power end strokes the cylinders via hydraulics, electric linear motors, roller screws, or long stroke linear mechanisms.

12. The method of claim 1, wherein the power end comprises only two hydraulic power sources for powering independent movements of the three plungers within their corresponding cylinders.

13. A method, comprising:

pumping treatment fluid to a wellbore via a long stroke pump comprising a fluid end and a power end, wherein the long stroke pump comprises three fluid cylinders within the fluid end, wherein the power end powers the movement of three plungers, each of the three plungers located within a corresponding one of the three fluid cylinders, wherein the movement of the plungers within their corresponding fluid cylinders is decoupled, wherein the movement of each of the three plungers within the corresponding fluid cylinder is controlled by a common timing pulse via a control system, wherein the common timing pulse determines a known position in each stroke for each of the three plungers, wherein pumping the treatment fluid comprises stroking each of the three plungers within their respective fluid cylinders through a three-phase cycle, wherein the three-phase cycle comprises:

a suction phase whereby the plunger is moved backward in the fluid cylinder to draw treatment fluid into the fluid cylinder from a suction line;

a pre-compression phase whereby the plunger is moved slowly forward in the fluid cylinder in an increment sufficient to compress the treatment fluid and expand the fluid end; and a discharge phase whereby the plunger is moved quickly forward in the fluid cylinder to discharge the treatment fluid from the fluid cylinder under pressure to a discharge line.

14. The method of claim 13, further comprising measuring a position of each of the plungers via position sensors and determining, based on the measured position of each of the plungers, a volumetric efficiency for each of the three fluid cylinders.

15. The method of claim 13, further comprising measuring a position of each of the plungers via position sensors and determining, based on the measured position of each of the plungers during the pre-compression phase, a presence of leakage in a suction valve at the suction line.

16. The method of claim 13, further comprising measuring a pressure within each of the fluid cylinders via pressure sensors and determining, based on the measured pressure of each of the fluid cylinders after the suction phase but prior to the pre-compression phase, a presence of leakage in a discharge valve at the discharge line.

17. The method of claim 13, further comprising recovering energy from a drive side of each of the plungers after completing the discharge phase.

18. The method of claim 13, further comprising controlling the long stroke pump to maintain a constant flowrate through the suction line during pumping of the treatment fluid.

19. The method of claim 13, wherein the power end comprises a drive system, wherein the drive system is selected from the group consisting of: one or more engines powering pumps, an electric motor, and an electric driven force actuator.

20. The method of claim 13, wherein the power end strokes the cylinders via hydraulics, electric linear motors, roller screws, or long stroke linear mechanisms.

* * * * *